US007404560B2

(12) United States Patent
Chen

(10) Patent No.: US 7,404,560 B2
(45) Date of Patent: Jul. 29, 2008

(54) BLACKJACK'N BACCARAT WITH JOKERS (B AND BJ)

(76) Inventor: Hui Chuan Chen, 212 Taffrail Rd., Apt# 3, Quincy, MA (US) 02169

( * ) Notice: Subject to any disclaimer, the term of this patent is extended or adjusted under 35 U.S.C. 154(b) by 0 days.

(21) Appl. No.: 10/895,572

(22) Filed: Jul. 20, 2004

(65) Prior Publication Data

US 2006/0017228 A1 Jan. 26, 2006

(51) Int. Cl.
*A63F 1/00* (2006.01)

(52) U.S. Cl. ..... 273/292; 273/274; 463/12

(58) Field of Classification Search ..... 273/292, 273/274, 309; 463/12, 13
See application file for complete search history.

(56) References Cited

U.S. PATENT DOCUMENTS

| | | | | | |
|---|---|---|---|---|---|
| 5,328,189 | A * | 7/1994 | Malek | ..... | 273/292 |
| 5,538,252 | A * | 7/1996 | Green | ..... | 273/306 |
| 5,636,843 | A * | 6/1997 | Roberts | ..... | 273/292 |
| 5,836,586 | A * | 11/1998 | Marks et al. | ..... | 273/292 |
| 6,733,011 | B2 * | 5/2004 | Su | ..... | 273/292 |

* cited by examiner

*Primary Examiner*—Benjamin Layno

(57) ABSTRACT

A variation of baccarat card game is played with six or eight decks standard 53 playing cards with one joker in each deck. It is playing as the traditional baccarat game. It provides variety optional side bets, such as, banker blackjack, banker 21, banker 17, player blackjack, player 21 and player 16 beside the main wagering areas, Banker, Player and Tie. The jokers serve as winning cards.

1 Claim, 1 Drawing Sheet

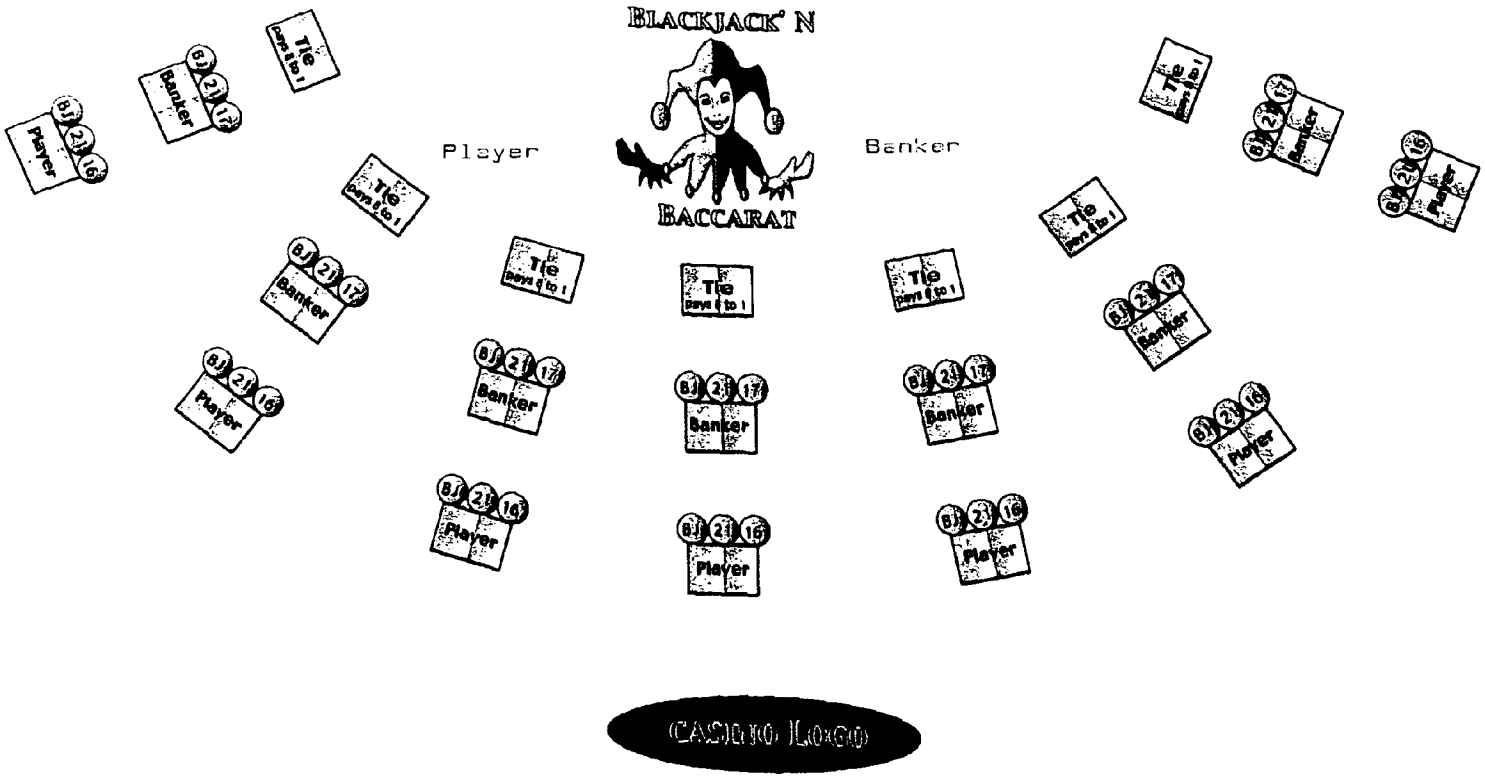
BLACKJACK'N
BACCARAT
Banker
Player
Tie
Pays 8 to 1
Banker
Player
CASINO HOST

BLACKJACK'N BACCARAT WITH JOKERS (B AND BJ)

CROSS-REFERENCE TO RELATED APPLICATIONS

Not Applicable

BACKGROUND OF THE PRESENT INVENTION

1. Field of the Invention

This invention relates generally to card games, such as, blackjack and baccarat.

2. Description of Related Arts

The object of the game, Baccarat, is to receive a hand value close to 9. The game is designed into two major betting areas said Banker and Player with a side bet area said tie. An ace has a value of 1 or 11 in blackjack game and a value of 1 in baccarat game. Cards 2 through 9 have point values equal to their face values. (E.g. 2 of spades has a point value 2) 10s, Jacks, Queens, and Kings have a point value of zero when it is a part of component in baccarat game and a point value of ten in blackjack game.

In traditional Baccarat card game, two cards are first dealt to player's hand and two cards are first dealt to banker's hand. An additional card may be dealt depending on the total numerical value of two cards of the "Player" and "Banker" respectively. Each player invests a desired amount of money in either Banker or Player of two designed betting areas in order to start a particular round of games.

A two-card point total of 9 is called a "natural" and this is the highest value hand cannot lose. A two-card point total of 8 is also called a "natural" and this is second-highest value hand. In the event of a tie between the Player's hand and the Banker's hand neither the Banker nor the Player wins. By comparing the total numerical value of the Banker and Player, the party having a higher total numerical value will be the winning party.

The patron who invested the amount of money in the winning said Player or Banker would be paid even money from the house (casino). The patron who invested the amount of money in the winning said tie would be paid 8 to 1. There is a 5% commission has to paid to the casino when the Banker wins.

When the player stands on 6 or 7, the banker will always draw on totals of 1, 2, 3, 4, and 5, and stands on 6, 7, 8, and 9. When player does not have 6, 7, natural 8 or natural 9, and has to draw the third card, the banker shall always draw on the totals of 0, 1, or 2, and then follows the rules.

(a) If banker has 3 and player's third card is 8, the banker cannot draw the third card.

(b) If banker has 4 and player's third card is 1, 8, 9, or 0, the banker cannot draw the third card.

(c) If banker has 5 and player's third card is 1, 2, 3, 8, 9, or 0, the banker cannot draw the third card.

(d) If banker has 6 and player's third card is 1, 2, 3, 4, 5, 8, 9, or 0, the banker cannot draw the third card.

The object of the game, Blackjack, is to receive the Blackjack, an Ace and a 10 or a face card said jack, queen, or king to be award 3 to 2 payout from the house (casino). The highest total point of blackjack game is 21. When both dealer and a player have a Blackjack, it results a tie hand, player does not lose or win.

Blackjack is a house bank game that patrons get dealt initially two cards. Players then have to make a decision to take a hit, stand on the numerical value his/her hand, or surrender. In order to win his or her wager, the cards in patron's hand must have a higher total point value than the total point value in the dealer's hand without going over twenty-one points.

Each patron places wager on the betting circle and initially receive two cards face up. After dealer receives two cards, one is face down (hole card), each player may select to draw additional cards in order to improve his or her hand without exceeding twenty-one, stand (not drawing any additional card) or surrender (losing half of the bet to give out his or her hand).

Dealer is required to take a hit when the two cards total value is under 17 (11 to 16) and stand on 17 or soft 17 (an ace and a 6).

BRIEF SUMMARY OF THE INVENTION

The present invention, Blackjack'n Baccarat with jokers, is a modified baccarat game with the jokers as the winning cards. It provides side bets, such as blackjack, 21, 16, and 17, are seen in the blackjack card game. Adding the jokers into the shoe increases the winning probability of Player hand. The object of Blackjack'n Baccarat with jokers is adding more ways of winning on Baccarat part and without drawing excess cards on Blackjack part.

However, patrons would not be dealt any cards for them to play the blackjack card game. The side bets is played based on the outcomes of designed betting spots of player hand and banker hand that is for patrons to place their wagers. There is no traditional blackjack card game procedure involved.

A multiple number of decks (six or eight) of standard playing cards, 52 in number with a joker, total 53 cards, are used; typically eight decks are shuffled together and placed in a shoe from which the cards are dealt during the play of the game.

The Blackjack'n Baccarat with Jokers card game is allowing patrons to play two games in one sitting based on the rules of baccarat card game.

When the game is using baccarat rules, the aces count as one. Kings, Queens, Jacks and Tens count as zero and the other cards count their respective face value. The suits, Spades, Hearts, Diamonds and Clubs, have no meaning in Blackjack'n Baccarat with Jokers.

When the game is using blackjack rules, the aces count as one or eleven. Kings, Queens, Jacks and Tens count as ten and the other cards count their respective face value. The suits, Spades, Hearts, Diamonds and Clubs, have no meaning in Blackjack'n Baccarat with Jokers.

The highest hand value in Blackjack'n Baccarat with jokers is nine. All hand values range from a low of zero to a high of nine.

When the cards are added together, the total of the hand exceeds nine, then the hand value is determined as ten.

For example, a seven and eight total fifteen, but the hand value is five. Any hand having a value that is ten or a multiple of ten is zero.

For example, an Ace and a nine total ten, but the hand value is zero.

BRIEF DESCRIPTION OF DRAWINGS

The design of table layout of Blackjack'n Baccarat with Jokers game is based on the layout of traditional baccarat game.

DETAILED DESCRIPTION OF THE PREFERRED EMBODIMENT

Rules of Blackjack'n Baccarat with jokers:

(a) If the initial two card Player hand has a point total of 0, 1, 2, 3, 4 or 5, the Player hand draws a third card. If the initial two-card Player hand has a point total of 6 or 7, the Player hand stands and does not receive a third card.

(b) If the Player hand stands and does not draw a third card, then the Banker hand follows Rules. In other words, if the Player hand has a point total of 6 or 7, the Banker hand draws a third card on a point total of 0, 1, 2, 3, 4 or 5 and the Banker hand stands on a point total of 6 or 7.

(c) If the Player hand draws a third card, the Banker hand must draw or stand in accordance with rules that are well known.

(c.1) The banker hand shall always draw on the totals of 0, 1, or 2, and stand on 7, natural 8, or natural 9.

(c.2) If banker has 3 and player's third card is joker or 8, the banker cannot draw the third card.

(c.3) If banker has 4 and player's third card is joker, 1, 8, 9, or 0, the banker cannot draw the third card.

(c.4) If banker has 5 and player's third card is joker, 1, 2, 3, 8, 9, or 0, the banker cannot draw the third card.

(c.5) If banker has 6 and player's third card is joker, 1, 2, 3, 4, 5, 8, 9, or 0, the banker cannot draw the third card.

The patrons have the option to select betting on the banker hand of blackjack, 21, 17 and the player hand of blackjack, 21, 16, and tie with ante on the banker or player.

The patrons cannot place the bet on banker hand of blackjack, 21, 17 and the player hand of blackjack, 21, 16, and tie without interest in placing ante on the banker or player.

The game is played with 6 or 8 decks of regular 52-card playing card with one joker, hence there are 318 cards for 6 decks B&BJ and 424 cards for 8 decks B&BJ.

Ace through Nine cards has respective point values of 1 to 9. Tens, Jacks, Queens and Kings have a point value of zero. Ace also has a respective point 1 or 11. Tens, Jacks, Queens and Kings also have a point value of 10.

A hand value of either player or banker hand is equal to a total point value of first two cards or first two cards plus one additional card. When a total hand value of either player or banker hand is ten, or over ten, the digit on the ten's place is ignored when determining a hand value of either player or banker hand. Hence, the higher value of a hand can get is 9. The hand with the higher value or joker wins.

B&BJ card game also permits patrons wager on six different traditional blackjack hands which are banker blackjack, banker 21, banker 17 and player blackjack, player 21, player 16, to be eligible to receive a corresponding bonus payout.

Each individual patrons do not get deal their own hand as traditional blackjack game. If the banker was the winner, the patrons who won must pay a 5% commission on their winnings.

B&BJ card game can also be playing without jokers. The total number of eight decks Blackjack'n Baccarat without jokers will be 416. The rules and payouts remain the same as Blackjack'n Baccarat with Jokers.

The invention claimed is:

1. A method of playing a Baccarat card game using Joker cards and using side bets relating to Blackjack outcomes comprising the steps of:

(a) providing a card game table, the card game table having a layout comprising:

a Player hand position and a Banker hand position located in the center of the game table;

a plurality of betting areas, each betting area having a Tie betting spot, a Banker hand betting spot, a Banker BJ betting spot, a Banker 21 betting spot, a Banker 17 betting spot, a Player hand betting spot, a Player BJ betting spot, a Player 21 betting spot, and a Player 16 betting spot;

(b) providing at least one deck of playing cards, wherein each deck of playing cards comprises at least one Joker and four suits of cards, each suit including a Two card, a Three card, a Four card, a Five card, a Six card, a Seven card, an Eight card, a Nine card, a Ten card, a Jack card, a Queen card, a King card, and an Ace card;

(c) positioning each patron, at the card game table, next to player betting area;

(d) requiring each patron to place a bet on either the Player hand betting spot or the Banker hand betting spot or both;

(e) permitting each patron the option of placing bets on one or more side bets that include the Tie betting spot, the Banker BJ betting spot, the Banker 21 betting spot, the Banker 17 betting spot, the Player BJ betting spot, the Player 21 betting spot, and the Player 16 betting spot;

(f) shuffling the at least one deck of cards;

(g) playing Baccarat by dealing an initial two-card hand to the Banker hand position and dealing an initial two-card hand to the Player hand position;

(h) assigning point values to the cards in the Banker hand and in the Player hand according to Baccarat rules, wherein the Ace through Nine cards having respective point values of 1 through 9, the tens, Jacks, Queens and Kings all having a point value of 0:

(i) determining the point total of the initial two-card Banker hand and the initial two-card Player hand by summing up points of each of the initial two-card Banker hand and the initial two-card Player hand;

(j) dealing additional cards to the Banker hand position and to the Player hand position if necessary according to Baccarat rules;

(k) determining the final point totals of the Banker hand the Player hand according to Baccarat rules wherein if the sum of two or three cards in a hand exceeds 10, only the last digit is used in determining the final point total;

(l) comparing the final point totals of the Banker hand and the Player hand, the hand having the higher point total being the winning hand, wherein an initial two-card hand with a Joker is the highest hand and can never lose, an initial two-card having a point total of 9, called a natural, is the second highest hand, and an initial two-card hand having a point total of 8, also called a natural, is the third highest hand;

(m) paying-off patrons that placed bets on a winning hand;

(n) collecting bets from patrons that placed bests on the hand having the lower point total;

(o) resolving the side bets after the Baccarat game is played in steps (g)-(n);

(p) paying-off patrons that placed side bets on the Tie betting spot when the Player hand and the Banker hand have the same final point totals;

(q) assigning point values to the cards in the final Banker hand and in the final Player hand according to Blackjack rules, wherein the Two through Nine cards having respective point values of 2 to 9, the Tens, Jacks, Queens, and Kings cards all having a point value of 10, and the Ace cards having a point value of 1 or 11;

(r) determining the final point total of the Banker hand and the Player hand according to Blackjack rules, wherein an initial two-card Banker hand and an initial two-card Player hand having a Ten or any face card with an Ace is referred to as Banker BJ and Player BJ respectively, a Banker hand having two or three cards having a final point total of 21 or 17 is referred to as Banker 21 or Banker 17, respectively, a Player hand having two or three cards having a final point total of 21 or 16 is referred to as Player 21 or Player 16, respectively;

(s) paying-off patrons that placed side bets on the Banker BJ betting spot and/or on the Player BJ betting spot when the initial two-card Banker hand and/or the initial two-card Player hand have a Ten or any face card with an Ace;

(t) paying-off patrons that placed side bets on the Banker 21 betting spot or Banker 17 betting spot when Banker has two or three cards having a final point total of 21 or 17, respectively;

(u) paying-off patrons that placed side bets on the Player 21 betting spot or Player 16 betting spot when Player has two or three cards having a final point total of 21 or 16, respectively.

* * * * *